US006200234B1

(12) United States Patent
Hannon

(10) Patent No.: US 6,200,234 B1
(45) Date of Patent: Mar. 13, 2001

(54) PORTABLE SOCCER GOLF GAME

(76) Inventor: Robert Hannon, 101 City of David, Benton Harbor, MI (US) 49022

( * ) Notice: Subject to any disclaimer, the term of this patent is extended or adjusted under 35 U.S.C. 154(b) by 0 days.

(21) Appl. No.: 09/396,601

(22) Filed: Sep. 15, 1999

Related U.S. Application Data

(63) Continuation-in-part of application No. 09/065,835, filed on Apr. 24, 1998, now abandoned.
(60) Provisional application No. 60/041,658, filed on Apr. 24, 1997.

(51) Int. Cl.[7] ..... A63B 67/00
(52) U.S. Cl. ..... 473/471; 473/410
(58) Field of Search ..... 473/471, 410, 473/150, 151, 158, 159, 165, 167, 169, 170, 195, 197, 217

(56) References Cited

U.S. PATENT DOCUMENTS

| | | | | |
|---|---|---|---|---|
| 2,157,023 | * | 5/1939 | Shannon | 273/118 R |
| 2,220,291 | * | 11/1940 | Savoy | 473/217 |
| 3,464,703 | * | 9/1969 | Vallas | 473/158 |
| 4,116,446 | | 9/1978 | Thompson . | |
| 4,407,507 | * | 10/1983 | Caruso et al. | 273/400 |
| 5,186,469 | | 2/1993 | Terris . | |
| 5,209,493 | | 5/1993 | Chernek . | |
| 5,308,083 | | 5/1994 | Grunfeld et al. . | |
| 5,431,411 | | 7/1995 | Padilla . | |
| 5,505,452 | * | 4/1996 | Meaden | 473/154 |
| 5,586,768 | | 12/1996 | Pavonetti . | |

* cited by examiner

*Primary Examiner*—Jeanette Chapman
*Assistant Examiner*—M. Chambers
(74) *Attorney, Agent, or Firm*—Bliss McGlynn P.C.

(57) ABSTRACT

A portable soccer golf game in which the players arrange a course comprising a plurality of independent and successive stations each defined by a starting location and a goal location according to the available space and their particular skill level. The game is played by placing goals at the various goal locations, whereby a player kicks a soccer ball from the designated starting location along any desired path toward the given goal location with the intent of getting the ball in the goal. The player with the fewest number of kicks to complete the course is the winner.

20 Claims, 2 Drawing Sheets

32

| | Station | | | | | | | | | |
|---|---|---|---|---|---|---|---|---|---|---|
| Player | 1 | 2 | 3 | 4 | 5 | 6 | 7 | 8 | 9 | 10 |
| Player 1 | | | | | | | | | | |
| Player 2 | | | | | | | | | | |
| Player 3 | | | | | | | | | | |
| Player 4 | | | | | | | | | | |

PORTABLE SOCCER GOLF GAME

RELATED APPLICATIONS

This application is a continuation in part of U.S. Ser. No. 09/065,835, filed Apr. 24, 1998, now abandoned, which claims priority to and all the benefits of provisional application U.S. Ser. No. 60/041,658, filed Apr. 24, 1997.

FIELD OF THE INVENTION

The subject invention relates to a portable soccer golf game which is played by combining some of the aspects of soccer and golf.

BACKGROUND OF THE INVENTION

By way of background, the game of soccer is played between two teams of eleven players on a rectangular outlined field with opposing goals, in which, a ball may be advanced by the opposing players by kicking or by bouncing it off any part of the body, except the arms and hands, toward the opposing team's goal. The game of golf is played by individual players, in which, golf clubs are used to hit a small golf ball into a number of holes, usually nine or eighteen, in succession. The holes are situated at various distances over a course having natural and artificial obstacles with the object of the game being to get the ball into each hole in as few strokes as possible.

Various other games have been developed using similar elements and rules of the games of soccer and/or golf. For example, U.S. Pat. No. 2,157,023 to Shannon, issued May 2, 1939, discloses the method of kicking a ball from a starting location through a plurality of hazards and wickets to a goal location. The ball must be kicked along a predetermined path around a course and advanced through each of the hazards and wickets between the starting location and the goal location. Additionally, U.S. Pat. No. 2,220,291 to Savoy, issued Nov. 5, 1940, discloses an attachment for a shoe to receive a striker head for kicking a golf ball around a golf course in accordance with the rules of golf, but without the use of conventional golf clubs.

SUMMARY OF THE INVENTION

A method of playing a soccer golf game comprises the steps of arranging a course layout comprising a plurality of independent and successive stations wherein each station includes a designated starting location spaced a predetermined distance from a designated goal location defined by a goal. A fixed number of players are selected to participate in the game and a resilient ball is associated with each of the players at one of the designated starting locations. One of the players is selected to initiate the game by kicking the player associated ball from the designated starting location along any desired path toward the associated designated goal location with the intent to kick the ball into the goal. The players repeat the kicking of the ball until the ball is received in the goal wherein the goal comprises a main frame supporting a net and a support frame for supporting the goal at the goal location. The number of kicks required by each of the players to advance the associated ball into the goal is counted and recorded by the players on a scorecard. Finally, the game continues by the player moving to the designated starting location of the next successive station until all stations have been played.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENTS

Figures 1, 2:
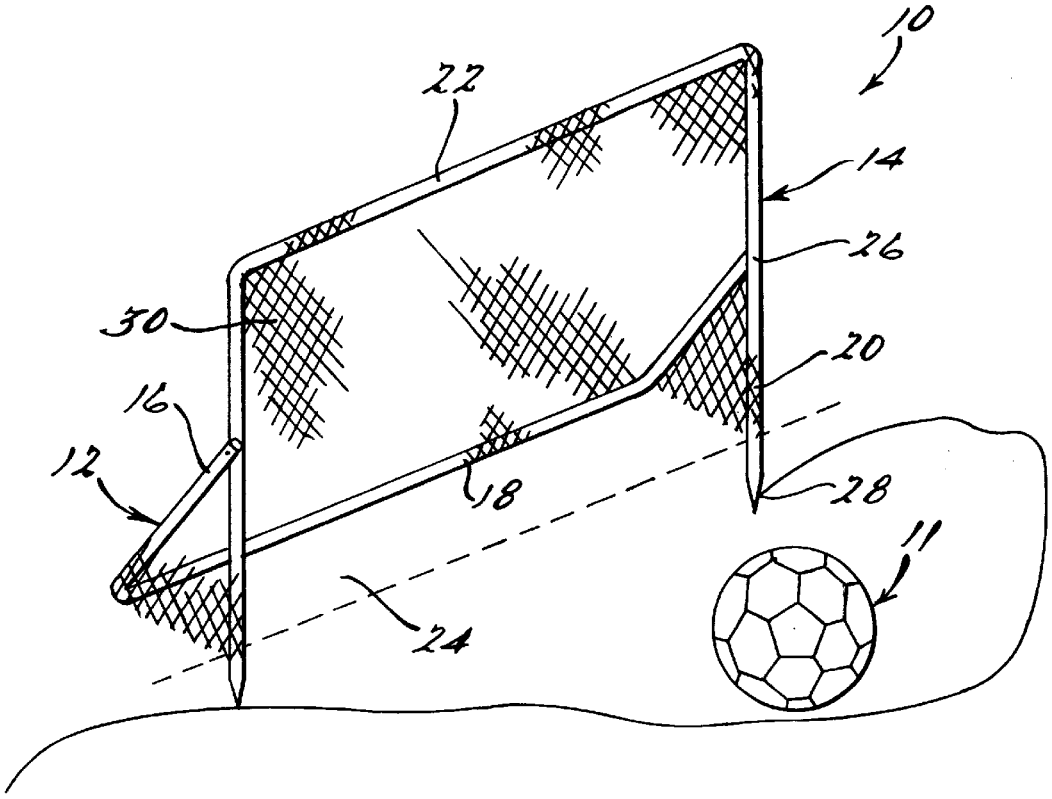
FIG. 1 is a perspective view of the subject invention's goal in the use position.
FIG. 2 is a plan view of the scorecard of the subject invention.
Figure 3:
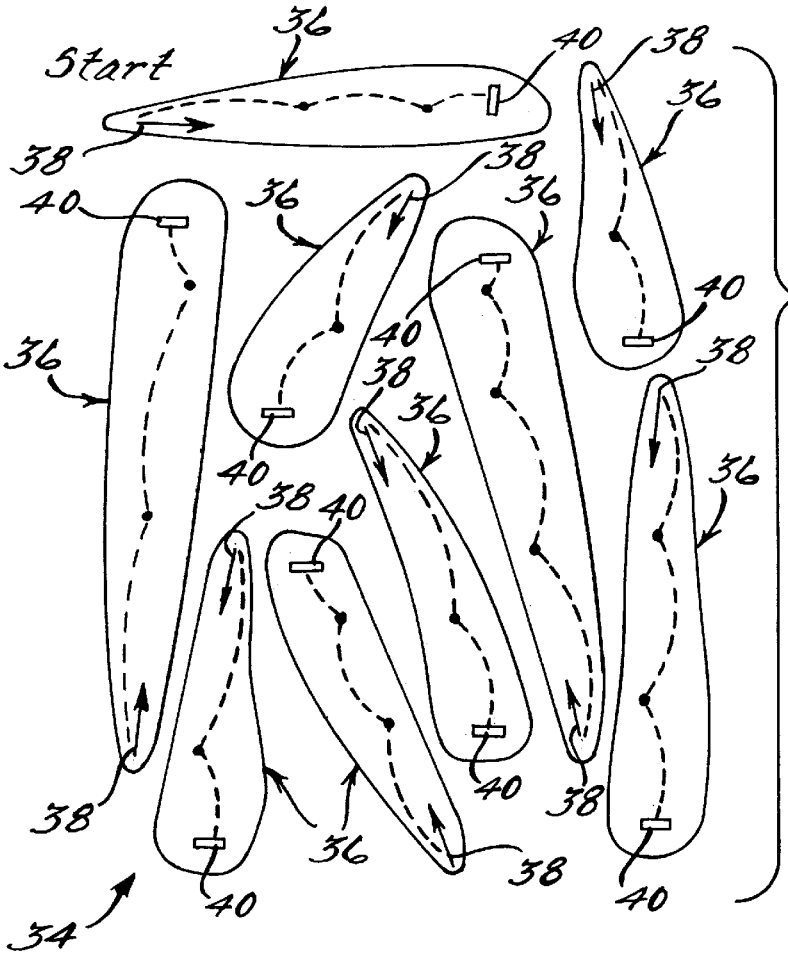
FIG. 3 is a plan view of a preferred playing course of the game according to the subject invention.

The subject invention relates to an outdoor activity game combining some of the aspects of soccer and some of golf, in addition to some new rules of the game. Referring to FIGS. 1–3, the equipment of the game is shown including at least one goal, generally shown at 10, at least one resilient ball 11 such as a type #3 soccer ball, at least one scorecard 32, writing utensils and an air pump to inflate the ball when necessary. The goal 10 includes a support frame 12 pivotally mounted to a main frame 14. The support frame 12 includes a pair of extension arms 16 interconnected by a crossmember 18. The main frame 14 includes a pair of posts 20 20 interconnected by a crossbar 22 forming a goal mouth 24. The posts 20 include a hole 26 located at approximately midway along the length of each post 20. The distal ends of the extension arms 16 are pivotally mounted to the posts 20 via the holes 26. The posts 20 also include a conically shaped surface 28 located at the distal end of each post 20 for staking the posts 20, and thus the goal 10, into the ground. A net 30 is loosely attached to the main frame 14 and support frame 12 as is commonly known in the art.

Figure 4:
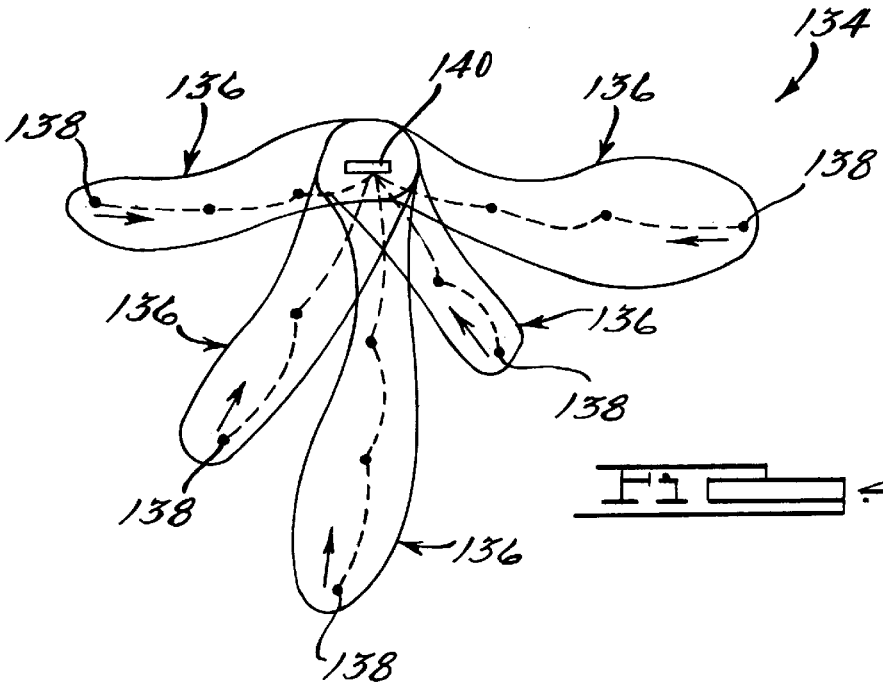
FIG. 4 is a plan view of an alternative embodiment of the playing course of the game according to the subject invention.

Referring to FIG. 3, a preferred set up or course layout is generally shown at 34. The course 34 of the game includes multiple stations or holes 36. Each station 36 includes a designated starting location 38 and a designated goal location 40. Alternatively, referring to FIG. 4, the set up of the game or course 134 is shown including multiple stations 136 having multiple designated starting locations 138 and a single goal location 140, or vice versa.

The number of stations 34,134 designated to be set up and the arrangement of these stations depends on the available space, the ability of the players involved and the degree of difficulty desired. The degree of difficulty can be increased by increasing the distance and/or number or position of obstacles, whether natural or artificial (i.e., trees, houses, etc.) between the starting locations 38,138 and goal locations 40,140 for a given station 36,136. In addition, the degree of difficulty can be adjusted by changing the size of the goal 10 and/or ball 11.

Having determined the course layout or configuration, the goal 10 is set up by staking the conically shaped surface 28 of each post 20 into the ground so as to sufficiently retain the posts 20 in a substantially vertical orientation. The support frame 12 is then pivoted rearward and away from the goal mouth 24 and the crossmember 18 is place along the ground, thus providing depth to and additional support for the goal 10.

When it is desired to remove the goal 10 from the course, the posts 20 are simply pulled upwards and away from the ground. After removing the goal 10 from the ground, the support frame 12 is pivoted forward so that the extension arms 16 rest along the side of the posts 20, thus allowing the goal 10 to be stored in a flat orientation.

The course 34 layout is unique in that it may be set up in any desired location. For example the portable soccer golf game may be set up in a back yard, an open field, a school, or any area desired with minimal effort. FIG. 3 illustrates a course layout comprising nine different stations 36 wherein the goal location 40 of each station is in close proximity to the starting location 38 of the next successive station 36, as shown. With this layout, the completion of all nine stations 36 returns the players to the original starting location 38 of the first stations 36 to either end the game or continue play on the nine stations again. Obviously, the number of stations 36 may be selected according to the desired number requested to be played by the players, or their skill level, or also based on the space available for the course layout.

Once the entire course is set up, depending on the desired number of holes, the game can begin. The basic object of the game is to kick the ball 11 from the starting location 38,138 into the goal 10 at the goal location 40,140 in the fewest number of kicks. The player having the lowest total number of kicks after completing the given number of stations wins the game.

The rules of the game require the ball 11 to be advanced by the players feet, that is, the player is only allowed to kick the ball 11. The method of playing the soccer golf game includes the steps of arranging the course layout comprising the plurality of independent and successive stations 36 wherein each station 36 includes the designated starting location 38 spaced a predetermined distance from the designated goal location 40 defined by the location of the goal 10. A fixed number of players are then selected to participate in the game and a ball 11 is providing and associated with each of the players to begin the game at one of the designated starting locations 38. One of the players is selected to initiate the game by kicking the associated ball 11 from the designated starting location 38 of the first station 36 along any desired path, direction, location or distance, toward the associated goal location 40 with the intent to kick the ball 11 into the goal 10. The advancement of the associated ball by the player into the goal 10 is defined by at least one half of the diameter of the ball must be extending into the mouth 24 or past the main frame 14 of the goal 10. The number of kicks required by each player to advance the associated ball 11 into the goal 10 are counted and the cumulative number of kicks by each player are recorded on the scorecard 32. Once each player has advanced their associated ball 11 into the goal 10 and recorded the number of kicks, all of the players move to the starting location 38 of the next successive station 36 to resume play.

The original order of play by the players kicking from the starting location 38 of the first station 36 is selected and determined by any method acceptable to the players. After each of the players has kicked their associated ball from the starting location 38, the player whose associated ball 11 is located furthest in distance from the goal location 40 is selected to repeat the kicking toward the goal location. Additionally, after all of the players have kicked their associated ball 11 from the starting location 38 of any station 36, each of the players has an option to mark the location and temporarily remove from play any other player's ball which is deemed to be in interference with the desired line of path toward the goal location 40 and then replace the other player's ball at the mark in its original position once the interference in relieved.

Once all of the players have advanced their associated ball into the goal 10, the player having the lowest number of kicks to advance their ball into the goal at the previous station initiates the kicking of their ball from the starting location 38 of the next successive station 36. The maximum number of kicks allowed to be recorded on the scorecard 32 by any player is determined and set to be ten kicks. After all of the designated stations 36 have been played and successfully completed by each of the players, the players add the number of kicks recorded on the scorecard 32 between the numbers of one and ten for the total number of consecutive stations to obtain a total score and record each player's total for all stations on the scorecard 32. The player with the fewest number of total kicks represented by the lowest total score is declared the winner of the game.

During play, if any of the players associated ball comes to rest and is touching any exterior portion of the goal 10, but is not inside the goal 10, the associated ball may be moved away from the goal a maximum distance equal to one diameter length of the ball 11. Additionally, a player and their associated ball is declared out of bounds anytime the players ball is behind the designated goal location 40. The player declared to be out of bounds is allowed to kick their ball until it is again positioned in front of the goal 10, that is, between the designated starting location 38 and the designated goal location 40, prior to any other players advancing their associated ball toward the goal location 40.

Still further, when any player kicks their associated ball out of turn, or prior to the player located furthest from the goal location and designated to kick next in turn, the out of turn player and their ball is returned to its prior location on the station 36 and the rules of the game allow the players to decide the option of not counting the out of turn players kick or accessing a penalty stroke against the player to be added and recorded on the scorecard 32. Similarly, if two or more players kick their associated balls at generally the same time, the player determined to have kicked out of turn defined by being closer in distance to the goal location, replaces their associated ball at its previous rest position and adds a penalty stroke to the cumulative number of kicks on the station for recording on the scorecard 32. However, if one player's ball is moved from its original rest position to a new rest position through normal play and contact by another player's ball, the first player must resume play from the new rest position after the contact and no penalty stroke is assigned to either player.

As can be appreciated, the subject invention includes some of the aspects of the game of golf and some of the game of soccer. However, the soccer golf game according to the subject invention includes new challenging course layouts which may be arranged in any available space and new rules different from golf and soccer to enhance the difficulty, enjoyment and equity among the players of the game.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced other than as specifically described.

What is claimed is:

1. A method of playing a soccer golf game comprising the steps of:

arranging a course layout comprising a plurality of independent and successive stations wherein each station includes a designated starting location spaced a predetermined distance from a designated goal location defined by a goal;

selecting a fixed number of players to participate in the game;

providing a resilient ball associated with each of said players at one of said designated starting locations;

selecting one of said players to initiate said game by kicking said player associated ball from said designated starting location along any desired path toward said associated designated goal location with the intent to kick said ball into said goal;

repeating said kicking of said ball by said player until said ball is received in said goal wherein said goal comprises a main frame supporting a net and a support frame for supporting said goal at said goal location;

when a first said player's associated ball is moved from its original rest position to a new rest position through contact by a second player's associated ball, said first player resumes the game from the new rest position of said associated ball;

counting the number of kicks required by each of said players to advance said associated ball into said goal;

recording said number of kicks by said player on a scorecard; and moving to said designated starting location of said next successive station.

2. The method as set forth in claim 1 further including the step of selecting an order in which each of said selected players is to initiate with kicking said associated balls from said starting location toward said goal location prior to each of said other selected players to begin the game.

3. The method as set forth in claim 2 wherein after each of said fixed number of players has kicked said associated ball from said starting location, selecting said player whose associated ball is located furthest in distance from said goal location relative to said associated balls of said other players to repeat said kicking of said associated ball toward said goal location.

4. The method as set forth in claim 3 further including the step of after all players have kicked said associated balls from said starting location, each of said players having an option to remove any other player's associated ball which is deemed to be in interference with said desired path toward said goal location and then replacing said other player's associated ball in its original positions once said interference is relieved.

5. The method as set forth in claim 4 further including each of said players proceeding to said designated starting location of said next successive station after each of said players has advanced said associated ball into said goal.

6. The method as set forth in claim 5 wherein said counting of the number of kicks required by each of said players on any said station includes setting a maximum allowable number of kicks to be recorded on said scorecard as ten kicks.

7. The method as set forth in claim 6 wherein said player having said lowest number of kicks to advance said associated ball into said goal at said previous station initiates said kicking of said associated ball from said starting location of said next successive station.

8. The method as set forth in claim in claim 7 further including adding the number of kicks recorded on said scorecard between the number of one and ten for ten consecutive stations to obtain a total score, recording said total score on said scorecard and declaring the player with the fewest number of kicks represented by the lowest total score as the winner of the game.

9. The method as set forth in claim 8 further including the step of when any of said players associated ball is touching any exterior portion of said goal, said associated ball is moved away from the goal a maximum distance equal to the diameter of said ball.

10. The method as set forth in claim 9 further including declaring said player and said associated ball out of bounds anytime said associated ball is behind said designated goal location and allowing said player to kick said ball until it is again positioned between said designated starting location and said designated goal location prior to any of said other players advancing said associated balls toward said goal location.

11. The method as set forth in claim 10 further including the step of when any player kicks said associated ball prior to said player located furthest from said goal location, said player's ball is returned to its prior location on said station and said kick is not counted.

12. The method as set forth in claim 11 wherein said advancement of said associated ball by said player into said goal is defined by at least one half the diameter of said ball extending past said main frame and into said goal.

13. The method as set forth in claim 12 further including altering the difficulty of said game by adjusting said distance between said starting locations and said goal locations.

14. The method as set forth in claim 13 further including altering the difficulty of said game by changing the position of said starting location and said goal location around various numbers and positions of obstacles.

15. The method as set forth in claim 14 further including altering the difficulty of said game by adjusting the dimensions of said goal.

16. The method as set forth in claim 15 further including providing a single common goal location associated with said plurality of starting locations for each of said stations.

17. The method as set forth in claim 16 wherein said resilient ball is a soccer ball.

18. The method as set forth in claim 17 wherein when two or more said players kick said ball at generally the same time towards said goal location, said player whose associated ball was determined to previously be closer in distance to said goal location replaces said associated ball at its previous rest position and adds a penalty stroke to the cumulative number of kick on said station for recording on said scorecard.

19. A method of playing a soccer golf game comprising the steps of:

arranging a course layout comprising a plurality of independent and successive stations wherein each station includes a designated starting location spaced a predetermined distance from a designated goal location defined by a goal;

selecting a fixed number of players to participate in the game;

providing a resilient ball associated with each of said players at one of said designated starting locations;

selecting one of said players to initiate said game by kicking said player associated ball from said designated starting location along any desired path toward said associated designated goal location with the intent to kick said ball into said goal;

repeating said kicking of said ball by said player until said ball is received in said goal wherein said goal comprises a main frame supporting a net and a support frame for supporting said goal at said goal location;

declaring said player and said associated ball out of bounds anytime said associated ball is behind said designated goal location and allowing said player to kick said ball until it is again positioned between said designated starting location and said designated goal location prior to any of said other players advancing said associated balls toward said goal location;

counting the number of kicks required by each of said players to advance said associated ball into said goal;

recording said number of kicks by said player on a scorecard; and moving to said designated staring location of said next successive station.

20. A method of playing a soccer golf game comprising the steps of:

arranging a course layout comprising a plurality of independent and successive stations wherein each station includes a designated starting location spaced a predetermined distance from a designated goal location defined by a goal;

selecting a fixed number of players to participate in the game;

providing a resilient ball associated with each of said players at one of said designated starting locations;

selecting one of said players to initiate said game by kicking said player associated ball from said designated starting location along any desired path toward said associated designated goal location with the intent to kick said ball into said goal;

repeating said kicking of said ball by said player until said ball is received in said goal wherein said goal comprises a main frame supporting a net and a support frame for supporting said goal at said goal location;

when two or more said players kick said ball at generally the same time towards said goal location, said player whose associated ball was determined to previously be closer in distance to said goal location replaces said associated ball at its previous rest position and adds a penalty stroke to the cumulative number of kicks on said station;

counting the number of kicks required by each of said players to advance said associated ball into said goal;

recording said number of kicks by said player on a scorecard; and moving to said designated starting location of said next successive station.

* * * * *